US008287993B2

(12) United States Patent
Crane et al.

(10) Patent No.: US 8,287,993 B2
(45) Date of Patent: Oct. 16, 2012

(54) SECURITY DEVICE AND NOVEL ANTI-COUNTERFEIT PRODUCT EMPLOYING SAME

(75) Inventors: Timothy T. Crane, Windsor, MA (US); Raj Sardararam Prehar, Mumbai (IN)

(73) Assignee: Crane & Co., Inc., Dalton, MA (US)

( * ) Notice: Subject to any disclaimer, the term of this patent is extended or adjusted under 35 U.S.C. 154(b) by 1125 days.

(21) Appl. No.: 11/662,328

(22) PCT Filed: Sep. 12, 2005

(86) PCT No.: PCT/US2005/032501

§ 371 (c)(1), (2), (4) Date: Aug. 14, 2007

(87) PCT Pub. No.: WO2007/001360

PCT Pub. Date: Jan. 4, 2007

(65) Prior Publication Data

US 2008/0305313 A1 Dec. 11, 2008

(30) Foreign Application Priority Data

Sep. 15, 2004 (IN) ..... 990/MUM/2004

(51) Int. Cl.
*B41M 3/14* (2006.01)

(52) U.S. Cl. ..... 428/211.1; 428/195.1; 428/913; 428/916; 283/92

(58) Field of Classification Search ..... 428/211.1, 428/195.1, 913, 916; 283/92
See application file for complete search history.

(56) References Cited

U.S. PATENT DOCUMENTS

| | | | | |
|---|---|---|---|---|
| 2,208,653 | A | | 7/1940 | Whitehead |
| 2,322,888 | A | * | 6/1943 | Schwartz et al. ..... 427/391 |
| 2,379,443 | A | | 7/1945 | Kantrowitz et al. |
| 2,913,356 | A | * | 11/1959 | Schroeder ..... 162/157.6 |
| 4,146,792 | A | | 3/1979 | Stenzel et al. |
| 4,310,591 | A | | 1/1982 | Lee et al. |
| 4,897,300 | A | | 1/1990 | Boehm |
| 4,908,063 | A | | 3/1990 | Baker et al. |
| 5,008,144 | A | | 4/1991 | Baker et al. |
| 5,035,946 | A | | 7/1991 | Baker et al. |
| 5,161,829 | A | | 11/1992 | Detrick et al. |
| RE34,329 | E | | 8/1993 | Baker et al. |
| RE34,647 | E | | 6/1994 | Baker et al. |
| RE34,792 | E | | 11/1994 | Baker et al. |

(Continued)

FOREIGN PATENT DOCUMENTS

CN 1410950 A 4/2003

(Continued)

OTHER PUBLICATIONS

"Additional Substrate Security", Thailand 2002, Security Papers UK.

*Primary Examiner* — Gerard Higgins
(74) *Attorney, Agent, or Firm* — Holland & Bonzagni, P.C.; Mary R. Bonzagni, Esq.

(57) ABSTRACT

Paper-based security devices having printed marks or indicia on one surface that are visible from that surface and from an opposing surface of the security device, are provided. The present invention further provides a method of making such paper-based security devices as well as security documents having at least one such security device embedded therein and/or mounted thereon.

20 Claims, 1 Drawing Sheet

U.S. PATENT DOCUMENTS

| | | | |
|---|---|---|---|
| 5,376,170 | A | 12/1994 | Baker |
| 5,449,200 | A | 9/1995 | Andric et al. |
| 5,465,301 | A | 11/1995 | Jotcham et al. |
| 5,565,276 | A | 10/1996 | Murakami et al. |
| 5,744,000 | A | 4/1998 | Athey et al. |
| 5,830,609 | A | 11/1998 | Warner et al. |
| 5,883,043 | A | 3/1999 | Halbrook, Jr. et al. |
| 6,045,656 | A | 4/2000 | Foster et al. |
| 6,054,021 | A | 4/2000 | Kurrle et al. |
| 6,089,614 | A | 7/2000 | Howland et al. |
| 6,138,913 | A | 10/2000 | Cyr et al. |
| 6,543,889 | B2 | 4/2003 | Murcia et al. |
| 6,582,556 | B2 | 6/2003 | Missell et al. |
| 6,592,716 | B1 | 7/2003 | Kim et al. |
| 6,616,803 | B1 | 9/2003 | Isherwood et al. |
| 6,770,687 | B1 | 8/2004 | Tan et al. |
| 2002/0058138 | A1 | 5/2002 | Kim et al. |
| 2002/0066543 | A1 | 6/2002 | Lilly |
| 2003/0082348 | A1 | 5/2003 | Washburn et al. |
| 2003/0228447 | A1 | 12/2003 | Letzelter et al. |
| 2005/0047593 | A1 | 3/2005 | Hampp |
| 2006/0014045 | A1 | 1/2006 | Einhorn et al. |
| 2006/0093821 | A1 | 5/2006 | Spinks |
| 2007/0050927 | A1 | 3/2007 | Cole et al. |
| 2007/0090196 | A1 | 4/2007 | Vast et al. |
| 2007/0170265 | A1 | 7/2007 | Sinclair et al. |
| 2007/0201720 | A1 | 8/2007 | Rodriguez et al. |
| 2007/0254138 | A1 | 11/2007 | Remmer |

FOREIGN PATENT DOCUMENTS

| | | | | |
|---|---|---|---|---|
| DE | 29808199 | | | 9/1999 |
| EP | 0 342 929 | A1 | | 11/1989 |
| EP | 0 557 157 | A1 | | 8/1993 |
| EP | 0844097 | | | 5/1998 |
| GB | 237828 | | | 8/1925 |
| GB | 1095286 | | | 12/1967 |
| GB | 1095286 | A | * | 12/1967 |
| JP | 02-133697 | | | 5/1990 |
| JP | 2293500 | | | 12/1990 |
| JP | 5098599 | | | 4/1993 |
| JP | 05-054210 | | | 3/1996 |
| JP | 2000-073298 | | | 3/2000 |
| WO | WO 99/45200 | | | 10/1999 |
| WO | WO 03/029003 | | | 4/2003 |
| WO | WO03/068525 | | | 8/2003 |
| WO | WO 03/095218 | A1 | | 11/2003 |
| WO | WO 2004/025028 | A1 | | 3/2004 |

* cited by examiner

SECURITY DEVICE AND NOVEL ANTI-COUNTERFEIT PRODUCT EMPLOYING SAME

RELATED APPLICATION

This application claims priority from Indian Patent Application No. 990/MUM/2004, filed Sep. 15, 2004.

FIELD OF THE INVENTION

The present invention relates to a paper-based security device having printed marks or indicia on one surface that are visible from that surface and from an opposing surface of the device. The present invention further relates to a method of making such a security device and to security documents having at least one such security device embedded therein and/or mounted thereon.

BACKGROUND OF THE INVENTION

Security papers such as certificates, financial papers, passports, bank notes and stamp papers, etc., suffer from severe issues of counterfeiting and hence need special protection. Several technologies are available to provide anti-counterfeit features to such paper products that vary from use of holograms, watermarks, incorporation of security threads, etc. However, new technologies and new or enhanced anti-counterfeit features are required to stay ahead of counterfeiters who use modern reprographic devices and specialized scanning equipment combined with commercially available high resolution printers to reproduce/simulate/counterfeit the end product.

The use of luminescent substances as a means (or additional means) for guaranteeing the authenticity of security papers, is known. For example, U.S. Pat. No. 4,897,300 A to Michael Boehm discloses a security thread comprising a tear-proof carrier material (e.g., polyester film) printed with luminescent colors that are invisible in normal lighting, but visible when exposed to, for example, ultraviolet radiation. The luminescent colors are provided along the carrier material in successive and overlapping portions, with overlapping areas showing mixed luminescence. This reference teaches at Col. 5, lines 13 to 18, that when an opaque carrier material is used, the carrier material may be printed on both sides, so that orientation of the thread while embedding the thread in paper is not a concern.

The security thread of U.S. Pat. No. 4,897,300 A necessarily requires the use of adhesives to bond the thread into or onto a security document such as paper.

PCT Publication No. WO 2004/025028 A1 discloses fibers that have a plurality of colored fluorescent stripes or regions printed on front and rear sides of the fiber. The stripes or regions are printed in at least two different colors with ultraviolet fluorescent pigments or inks and are only visible under ultraviolet light. This reference teaches that the pigments used for generating the printed stripes do not generally combine well (see page 2, lines 19 to 21, of WO 2004/025028 A1). As such, the overlapping of these stripes is deemed disadvantageous. In fact, this reference teaches that the pigments are selected so that there is no migration of colors into one another. (See, page 14, lines 1 to 5, of WO 2004/025028 A1).

The invention of WO 2004/025028 A1 necessarily requires that the printed regions are registered such that regions on the front and rear sides are registered with one another and in the same color. Such a requirement of registration, which is extremely difficult if not impossible to achieve, introduces several constraints such as limiting the flexibility of manufacturing routes and the need for stringent matching of registrations, which thereby enhances the rejection rates of the products.

There has been a long felt need in the security industry to further protect security papers by providing security features that are difficult to counterfeit and yet remain amenable to flexible and cost-effective manufacturing and to easy authentication by users and issuing authorities.

SUMMARY OF THE INVENTION

The present invention therefore provides a security device that comprises a paper substrate having printed marks or indicia on one surface that are visible from that surface as well as from an opposing surface of the substrate.

In a preferred embodiment, the printed marks or indicia are visible only under ultraviolet (UV) and/or infrared (IR) light.

In a more preferred embodiment, the security device is in the form of fibers (e.g., tissue paper strips) or planchettes and the marks or indicia are in the form of parallel stripes or bands that are printed in two or more colors using UV and/or IR fluorescent inks.

In another more preferred embodiment, the paper substrate contains a very thin coating of a clear or pigment-free varnish, which serves to: (i) increase the surface smoothness of the substrate, thereby allowing for more complex or intricate marks or indicia; and (ii) partially transparentize the paper substrate, thereby allowing for better resolution of the printed marks or indicia through the back side of the substrate.

The present invention further provides a method of making such security devices and to security documents having at least one such security device embedded therein and/or mounted thereon.

Other features and advantages of the invention will be apparent to one of ordinary skill from the following detailed description and accompanying drawings. Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BRIEF DESCRIPTION OF THE DRAWINGS

Particular features of the disclosed invention are illustrated by reference to the accompanying drawings in which.

DETAILED DESCRIPTION OF THE INVENTION

Figure 1:
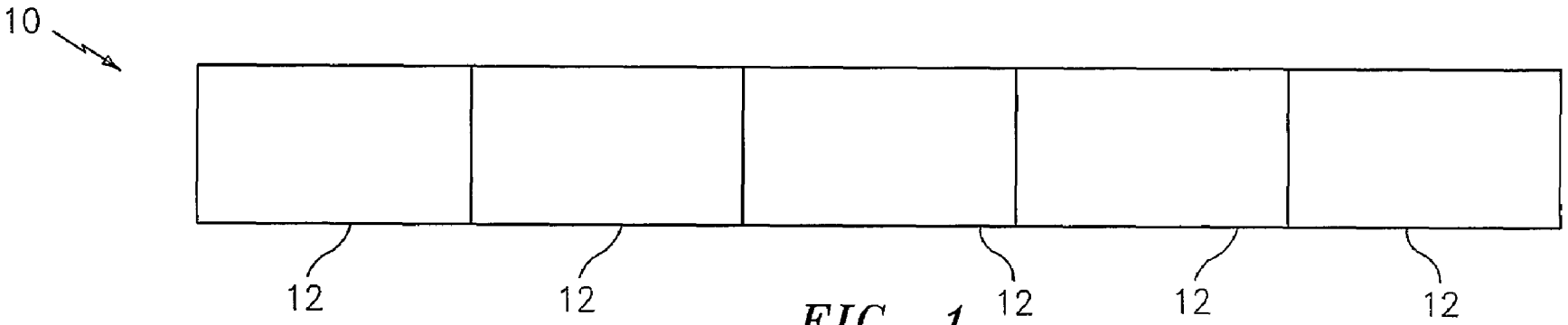
FIG. 1 is a schematic view of an arrangement of printed stripes or bands on a preferred embodiment of the inventive security device, which takes the form of a fiber or tissue paper strip.

The paper-based security devices of the present invention, which are suitable for use on or within security papers such as bank notes, passports, stamp papers, high security documents, and the like, offer the advantage that they may be added to security papers during manufacture without the need for additional equipment or modifications to existing equipment. The inventive paper-based devices are compliant when wet, which aids in handling, and bond naturally to papermaking fibers.

The paper-based security devices of the present invention offer the further advantage of single-sided printing which allows for perfect or near perfect registration between printed marks on opposing sides of the substrate.

Security devices in the form of fibers (i.e., strips) and planchettes are particularly useful in the present invention. The size and shape of these fibers and planchettes are not in any way limited or restricted.

As noted above, the paper-based security device of the present invention comprises a substrate having printed marks or indicia on one surface that are visible from that surface as well as from an opposing surface of the substrate.

Preferred substrates are tissue paper substrates devoid of optical brighteners that have a thickness ranging from about 15 to about 40 microns, preferably from about 20 to about 35 microns, and a basis weight ranging from about 5 to about 30 grams per square meter ($g/m^2$), preferably from about 21 to about 23 $g/m^2$. The density of the preferred tissue paper substrates is between about 0.3 and about 1.0 gram per cubic centimeter (g/cm;), preferably between about 0.6 and 0.7 g/cm;.

More preferred substrates are tissue paper substrates having a wet tensile strength (machine direction (MD)) of at least about 6.5 Newtons (N) per 25 millimeter (mm) width (preferably, from about 7.9 to about 10.6 N/25 mm), and a dry tensile strength (MD) of at least about 28.0 N/25 mm (preferably, from about 32.6 to about 41.9 N/25 mm).

A very thin coating (i.e., from about 2.3 to about 5.8 grams per square meter ($g/m^2$), preferably from about 3.5 to about 4.8 $g/m^2$) of a clear or pigment-free, non-yellowing varnish may be applied to an upper surface of the tissue paper substrate. The varnish serves to increase the surface smoothness of the substrate, thereby allowing for marks or images to be printed with enhanced image resolution. In other words, due to the increase in surface smoothness, marks that are more complex or intricate in design (e.g., letters, numbers, symbols) and thus far more difficult to effectively simulate, may be printed on the substrate thereby greatly increasing the counterfeit deterrent effect of these devices. The varnish serves a further purpose in partially transparentizing the tissue paper substrate. That portion of the varnish that is absorbed into the substrate fills voids and air spaces causing a reduction in light scattering and consequently a decrease in opacity. The enhanced image resolution enabled by this same varnish is better resolved through the back side of the tissue paper substrate as a result of the reduced opacity.

Suitable varnishes include, but are not limited to, radiation curable varnishes (e.g., UV radiation-curable varnishes), water-based varnishes (e.g., heat/air curable water-based varnishes), and solvent-based varnishes, with a preferred varnish being a heat/air curable water-based varnish, which is available from Environmental Inks and Coatings Corporation, 1 Quality Product Road, Morganton, N.C. 28655 ("Environmental Inks and Coatings Corporation"), under the product designation FILM III curable water-based coating.

The printed marks or indicia used in the practice of this invention may adopt any form and pattern including any type and combination of symbol, design, shape or other graphic indicia that may be visually detected and possibly machine detected or machine read.

In one embodiment, the security device is an elongated security device and the printed marks or indicia are contiguous stripes or bands that alternate in color along the length of the security device.

In another embodiment, the printed marks or indicia are letters, numbers and/or symbols that may alternate with colored stripes or bands along the length of the elongated security device.

The marks or indicia used in the practice of the present invention are preferably printed using water-based security inks. Security inks contemplated for use in this invention include, but are not limited to, UV visible and invisible fluorescent inks, IR visible and invisible fluorescent inks, thermochromic inks, photochromic inks, heat reactive-irreversible inks, optically variable inks, and solvent/chemical reactive inks.

In a preferred embodiment, the water-based security ink is a no-bleed UV or IR invisible fluorescent ink that demonstrates fade and abrasion resistance. Suitable UV invisible fluorescent inks include, but are not limited to, energy curable UV invisible fluorescent inks and heat/air curable UV invisible fluorescent inks, which are available from Environmental Inks and Coatings Corporation, under the product designations ENVIROCURE UV inks and FILM III coatings, respectively, while suitable IR invisible fluorescent inks include, but are not limited to, IR invisible fluorescent inks available from United Mineral & Chemical Corporation, 1100 Valley Brook Avenue, Lyndhurst, N.J. 07071, under the product designation UVEDA IRA inks.

As will be readily appreciated, the UV and IR fluorescent colors used in the manufacture of these preferred embodiments of the inventive security device are invisible in normal light conditions thereby not impacting upon the appearance of the host security paper in any manner.

The marks or indicia may be printed on the paper substrate using any printing method including, but not limited to, rotogravure, letterpress, intaglio, lithography, and flexography.

The paper-based security devices of the present invention may include one or more additional features, coatings, or layers; provided however that any such additional feature, coating, or layer does not interfere with the visual perception of the printed marks or indicia, nor the ability of the security devices to effectively bond to papermaking fibers. Contemplated additional features, coatings, or layers include, but are not limited to, light converting, magnetic, metal or metallic, and non-metallic conductive security features or devices, sealing layers, and outer protective layers.

The printed substrate of the present invention may be cut into desired shapes or forms (e.g., fibers and/or planchettes) using conventional methods and techniques. In one contemplated embodiment, the printed substrate is bias cut resulting in strips with a long axis and a short axis. Preferably, the longer axis of each fiber ranges from about 1 mm to about 10 mm (more preferably, from about 4 mm to about 8 mm), while the shorter axis of each fiber ranges from about 0.1 mm to about 1.0 mm (more preferably, from about 0.2 mm to about 0.4 mm).

Referring now to FIG. 1, a preferred embodiment of the inventive security device (in the form of a fiber) is shown generally at 10. In this embodiment, the inventive fiber 10 comprises a tissue paper substrate having marks 12 in the form of alternating printed stripes or bands of two or more colors (e.g., red, yellow, green, blue, orange, violet, blue/green, green/yellow) that extend along the length of the fiber 10, the printed stripes or bands being visible from both sides of the fiber 10 only under UV and/or IR light.

In the embodiment described above, printing is carried out on any one surface of the tissue paper substrate using UV and/or IR invisible fluorescent inks so as to achieve a predetermined sequence of parallel stripes or bands of colors having widths ranging from about 0.1 mm to about 5.0 mm (more preferably, from about 0.75 to about 1.5 mm), each color being applied in a separate printing station, the color stripes being appropriately registered along the length of the substrate so as not to leave any significant unprinted areas or overlapping areas.

In a more preferred embodiment (not shown), the inventive security device is a fiber that comprises a bleached, machine glazed, high wet strength tissue paper substrate having stripes or bands printed on one surface in two different UV and/or IR fluorescing colors that alternate along the length of the substrate. The alternating, colored stripes or bands are printed in register with each other such that there are no unprinted gaps between the bands or stripes and no overlap of colors.

Figure 2:
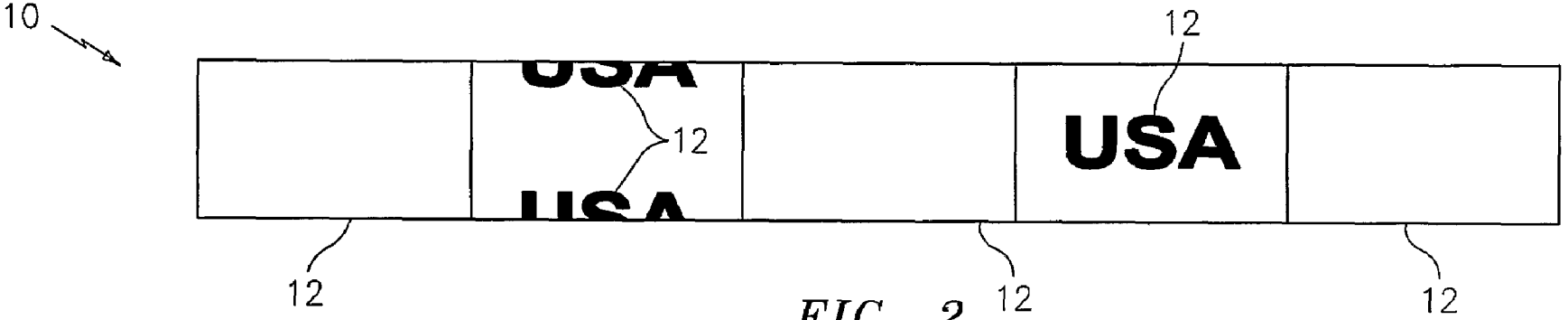
FIG. 2 is a schematic view of another preferred embodiment of the inventive fiber in which the marks or indicia in the form of colored stripes and text alternate along the length of the fiber.

In another more preferred embodiment, which is best shown in FIG. 2, the tissue paper substrate is a coated substrate and the marks 12 are in the form of both printed stripes and text (USA), which alternate along the length of the substrate. The printed stripes and text are visible from both sides of the fiber 10 only under UV and/or IR light.

The inventive security devices may be incorporated into security papers during manufacture by techniques commonly employed in the security papermaking industry. For example, the inventive devices may be mixed with the stock suspension fed to the papermaking machine so that the devices are randomly distributed among the normal papermaking fibers forming the security paper. The inventive security devices may also be introduced in a dilute suspension in water to a cylinder mold machine, or similar papermaking machine of known type, along with an appropriate suspension of papermaking fibers in such a way that the inventive devices only appear in designated bands within the security paper.

The printed marks or indicia on the security devices in the finished paper are visible from both faces of the paper and in a preferred embodiment are visible only under UV and/or IR light so as not to disturb in any way the appearance of the paper before and after the paper is printed.

While various embodiments of the present invention have been described above, it should be understood that they have been presented by way of example only, and not limitation. Thus, the breadth and scope of the present invention should not be limited by any of the exemplary embodiments.

Having thus described the invention, what is claimed is:

1. A security device suitable for use on or within a security document, which comprises an elongated tissue paper substrate having a length of from about 1 to about 10 millimeters, a wet tensile strength in the machine direction of at least about 6.5 Newtons per 25 millimeter width and opposing planar surfaces, wherein the substrate has marks all of which are printed on only one surface, all of the marks being visible only under ultraviolet and/or infrared light from the printed surface and all of the marks being visible from the opposing surface of the substrate.

2. The security device of claim 1, wherein the tissue paper substrate has a thickness ranging from about 15 to about 40 microns, a density ranging from about 0.3 to about 1.0 gram per cubic centimeter, and a basis weight ranging from about 5 to about 30 grams per square meter.

3. The security device of claim 1, wherein the marks are in the form of parallel stripes that are printed in two or more colors along the length of the elongated substrate using ultraviolet fluorescent inks and/or infrared fluorescent inks.

4. The security device of claim 1, wherein the marks are in the form of parallel stripes and text that are printed along the length of the elongated substrate using ultraviolet fluorescent inks and/or infrared fluorescent inks.

5. The security device of claim 1, wherein the security device further comprises a coating of a clear or pigment-free varnish on the tissue paper substrate, wherein the marks are printed on the varnish coating.

6. The security device of claim 5, wherein the clear or pigment-free varnish is a heat/air curable water-based varnish.

7. A security document having at least one security device as claimed in claim 1 embedded therein and/or mounted thereon.

8. The security document of claim 7, wherein the tissue paper substrate of the security device(s) has a thickness ranging from about 15 to about 40 microns, a density ranging from about 0.3 to about 1.0 gram per cubic centimeter, and a basis weight ranging from about 5 to about 30 grams per square meter.

9. The security document of claim 7, wherein the marks are in the form of parallel stripes that are printed in two or more colors along the length of the elongated substrate using ultraviolet fluorescent inks and/or infrared fluorescent inks.

10. The security document of claim 7, wherein the marks are in the form of parallel stripes and text that are printed along the length of the elongated substrate using ultraviolet fluorescent inks and/or infrared fluorescent inks.

11. The security document of claim 7, wherein the security device further comprises a coating of a clear or pigment-free varnish on the paper substrate, wherein the marks are printed on the varnish coating.

12. The security document of claim 11, wherein the clear or pigment-free varnish is a heat/air curable water-based varnish.

13. The security document of claim 7, wherein the at least one security device is incorporated in a substantially random position in the document.

14. A method of making a security paper, the method comprising, mixing the security devices of claim 1 with a stock suspension of papermaking fibers fed to a papermaking machine so that the security devices are randomly distributed among the papermaking fibers, and forming the security paper so that the security devices are incorporated randomly in the paper.

15. A security paper manufactured by the method of claim 14.

16. A method of making security devices, which comprises:

providing a tissue paper substrate having opposing planar surfaces, wherein the tissue paper substrate has a wet tensile strength in the machine direction of at least about 6.5 Newtons per 25 millimeter width;

optionally, coating a surface of the tissue paper substrate with a clear or pigment-free varnish;

printing marks on only one surface of the tissue paper substrate using ultraviolet fluorescent inks and/or infrared fluorescent inks; and cutting the printed tissue paper substrate into any desired shape or form.

17. The method of claim 16, which further comprises coating a surface of the tissue paper substrate with a clear or pigment-free varnish onto which the marks are printed.

18. The method of claim 16, wherein the tissue paper substrate has a thickness ranging from about 15 to about 40 microns, a density ranging from about 0.3 to about 1.0 gram per cubic centimeter, and a basis weight ranging from about 5 to about 30 grams per square meter.

19. A security device manufactured by the method of claim 16.

20. A security device suitable for use on or within a security document, which comprises a tissue paper substrate having a wet tensile strength in the machine direction of at least about 6.5 Newtons per 25 millimeter width and opposing planar surfaces, wherein the substrate has marks all of which are printed on only one surface, all of the marks being visible only under ultraviolet and/or infrared light from the printed surface and all of the marks being visible from the opposing surface of the substrate.

* * * * *